US005328411A

United States Patent [19]

Thornton, II

[11] Patent Number: 5,328,411

[45] Date of Patent: Jul. 12, 1994

[54] BILLIARD CUE CHALK HOLDER

[76] Inventor: Robert P. Thornton, II, 220 W. Country Circle Dr., Daytona Beach, Fla. 32124

[21] Appl. No.: 144,329

[22] Filed: Nov. 1, 1993

[51] Int. Cl.[5] ..... A63D 15/00

[52] U.S. Cl. ..... 473/36; 473/39

[58] Field of Search ..... 473/36, 39

[56] References Cited

U.S. PATENT DOCUMENTS

| | | | |
|---|---|---|---|
| 639,427 | 12/1899 | McLarty | 273/18 |
| 744,935 | 11/1903 | Pejchar | 273/18 |
| 965,444 | 7/1910 | Dahl . | |
| 2,628,096 | 2/1953 | Bell | 273/18 |
| 3,843,120 | 10/1974 | Ricci | 473/36 |
| 4,060,243 | 11/1977 | Langan | 273/18 |
| 4,953,770 | 9/1990 | Bond, Sr. | 224/250 |
| 5,046,728 | 9/1991 | Haddock | 473/36 |

FOREIGN PATENT DOCUMENTS

| | | | |
|---|---|---|---|
| 694637 | 9/1964 | Canada | 273/20 |

*Primary Examiner*—Theatrice Brown

*Attorney, Agent, or Firm*—Edward M. Livingston

[57] ABSTRACT

A billiard cue chalk holder (1) having a closed bottom (6), an open top (2), side walls (3) and a magnet (6) secured to the bottom (6). A chalk block (11) can be inserted into the open top (2) and held in a pressure fit between the side walls (3) of the holder. The chalk holder (1) with the chalk block (11) can then be attached by magnetic attraction to almost any metal surface, such as a plate under a billiard table or a key chain. The chalk holder (1) can also be combined with a belt or shirt clip (14) so it can be attached to a player's belt or shirt pocket during play. The belt clip (14) to which the chalk holder (1) is attached may also contain optional accessories, such as knife (20) for trimming and/or a rasp (21) for filing a tip of a cue stick. This invention prevents the loss of the chalk and eliminates the mess associated with keeping chalk on the billiard table.

8 Claims, 2 Drawing Sheets

BILLIARD CUE CHALK HOLDER

BACKGROUND OF THE INVENTION

This invention relates to devices for holding billiard cue chalk blocks, and more particularly to a combination device for magnetically holding chalk for attachment to a table, a belt clip or other metal surface, having optional accessories such as a rasp and utility knife.

When playing pool or billiards it is necessary to put chalk on the tip of the pool or billiard cue in order to increase friction between the tip of the cue stick and the ball; otherwise the cue tip will slip when it hits a ball, thereby producing an inaccurate strike. Billiard chalk normally comes in square blocks which, for the sake of convenience, are usually kept on the billiard table during play. Unfortunately, keeping the chalk block on the table results in chalk dust getting all over the billiard table, causing a unsightly mess. However, if the chalk block is kept elsewhere then often times the players have to hunt for the chalk, thereby breaking their concentration and delaying play. Also, when billiard cues become worn it is often necessary to file or trim the tips of the cues. Thus, in addition to a chalk holder, there is a need for a combination chalk holder with rasp and utility knife.

The prior art includes numerous billiard chalk holders, but none like the present device. For instance, U.S. Pat. No. 4,953,770 by Bond, Sr., issued Sep. 4, 1990, discloses a pool cue chalk holder having a clip attached to the clothing using Velcro for removably securing it to the clip. On the other hand, the present invention uses magnetic attachment means and contains a holder for the chalk block. Another U.S. Pat. No. 5,046,728 by Haddock, issued Sep. 10, 1991, teaches a chalk holder that has a middle clip with serrated scuffing service which is attachable to clothing and is designed to hold the chalk holder by magnetic means. However, the Haddock patent contains a magnet in the clip itself and not in the holder for the chalk block. Thus, unlike the present invention, which contains a magnet in the chalk holder itself, the Haddock chalk holder could not be used independently of the clip. U.S. Pat. No. 965,444 by Dahl, issued Jul. 26, 1910, shows a billiard cue chalk holder that fits over a finger like a ring. Other billiard cue chalk holders also attach the chalk to a player's hand by a ring-like device, such as U.S. Pat. No. 4,060,243 by Langan, issued Nov. 29, 1977; U.S. Pat. No. 744,935 by Pejchar, issued Nov. 24, 1903; and U.S. Pat. No. 639,427 by McLarty, issued Dec. 19, 1899. Other patents involving chalk holders include Canadian Patent 694,637 by Rodrique, issued Sep. 22, 1964, showing a spring-mounted chalk holder and U.S. Pat. No. 2,628,096 by Bell, issued Feb. 10, 1953.

In summary, although there are many billiard cue chalk holders in the prior patented art, none is exactly like the present invention as will become even more readily apparent from a detailed description of the present invention hereinafter.

SUMMARY OF THE INVENTION

The primary object of the present invention is to provide a holder for billiard chalk.

Another object of the present invention is to provide such a holder that allows billiard chalk to be easily changed as desired.

A further object of the present invention is to provide such a holder that can be removably attached to any metal surface as desired.

An even further object of the present invention is to provide such a billiard cue chalk holder that can be combined with a clip for attachment to a belt, a shirt pocket or the like, having with optional accessories, such as a rasp and a utility knife, for filing and trimming the tip of a billiard cue.

The present invention fulfills the above and other objects by providing a billiard cue chalk holder with a holding portion the approximate shape of a chalk holder, having a closed bottom wall, side walls and an open top into which the chalk block can be pressure fitted between the side walls of the holder. A magnet is secured to the bottom wall of the holder so that the holder may be attached to a metal object. Although the holder may be attached to any metal object, it may be attached to a metal clip so that it can be secured to a belt or shirt pocket. The clip may have two metal surfaces with a space between them, with the space containing a retractable knife and/or file rasp for trimming and filing the tip of a billiard cue, respectively. The billiard cue holder of this invention may also be attached to a metal plate under the billiard table itself or even to a key chain. Scissors may also be included in the clip as an optional accessory. The bottom of the magnet can be coated with a spray or adhesive which helps keep the magnet from scratching a metal surface to which it comes in contact.

Other objects and advantages of this invention may become even more readily apparent when a preferred embodiment of the device is described in conjunction with drawings.

BRIEF DESCRIPTION OF THE DRAWINGS

The drawing figures which are used to illustrate a preferred embodiment of the invention are as follows.

DESCRIPTION OF THE PREFERRED EMBODIMENTS

Figure 1:
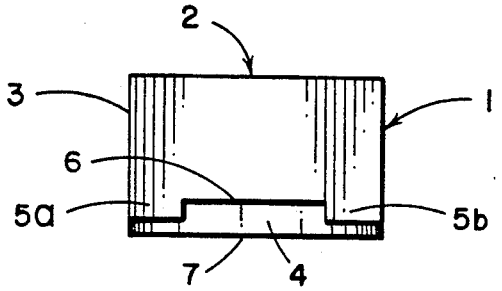
FIG. 1 is a side view of the billiard cue chalk holder of this invention by itself.
Figure 2:
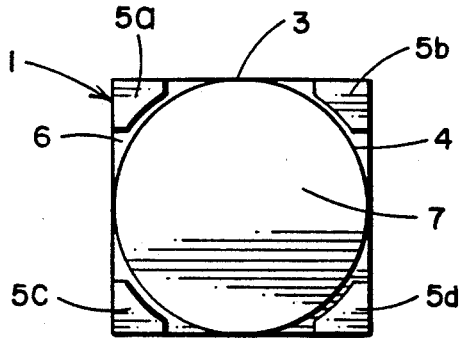
FIG. 2 is a bottom view of the billiard cue chalk holder of this invention by itself.
Figure 3:
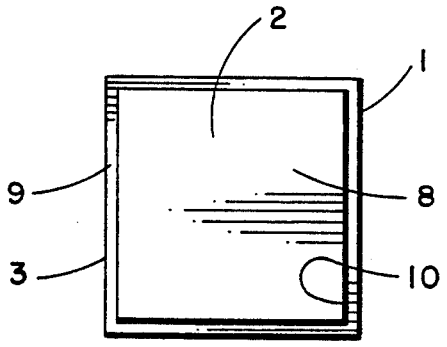
FIG. 3 is a top view of the billiard cue chalk holder of this invention by itself.

Referring now to the drawings, FIGS. 1, 2 and 3 show the billiard cue chalk holder generally 1 having a magnetic disk 4 affixed permanently to the outer bottom wall 6 by glue or other means. The chalk holder 1 would have approximately the same shape as a chalk block, whether it be square, round or rectangular, and would have a closed bottom 6, side walls 3 and an open top 2. The bottom 7 of the magnetic disk 4 could be magnetically secured to any metal surface. In order to avoid the metal disk 4 scratching a metal surface, a rubberized adhesive could be placed on the bottom 7 of the magnet 4. The chalk holder 1 itself may have corner extensions 5*a*, 5*b*, 5*c* and 5*d* to further secure in place the magnet 4 to the bottom wall 6 of the chalk holder 1. In FIG. 3 the open top 2 of the chalk holder 1 shows the inside floor 8 surrounded by side walls 3, having a top 9 and an interior side 10.

Figure 4:
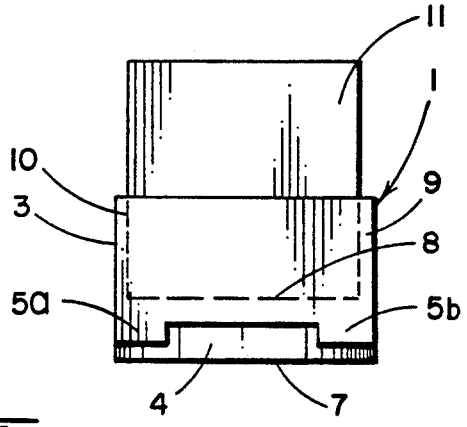
FIG. 4 is a side plan view of the billiard cue chalk holder with a chalk block inserted therein.

In FIG. 4 a chalk block 11 is shown pressure-fitted inside the interior side of the walls 3 against the interior bottom 8 of the chalk block holder 1.

Figure 5:
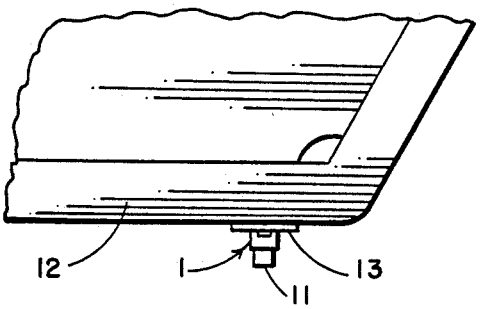
FIG. 5 is a side partial view of a billiard cue chalk holder containing a chalk block attached to a metal plate under a billiard table.

FIG. 5 shows the chalk block holder 1 with chalk block 11 being attached to a metal plate 13 on the bottom side of a billiard table 12. In this manner the chalk is always be available for use by a player and would be less likely to cause a mess on the billiard table 12.

Figure 6:
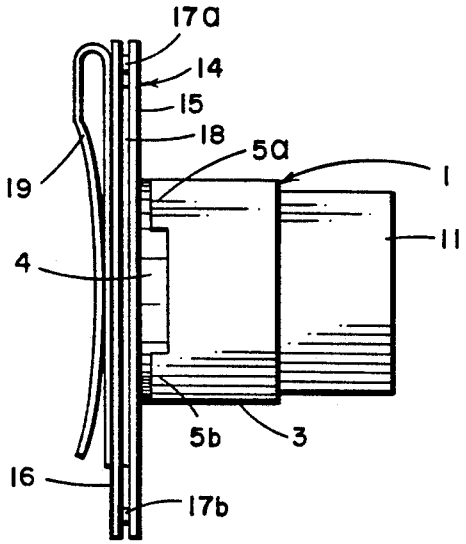
FIG. 6 is a side view of the billiard cue chalk holder of this invention containing a chalk block and attached to shirt clip.
Figure 7:
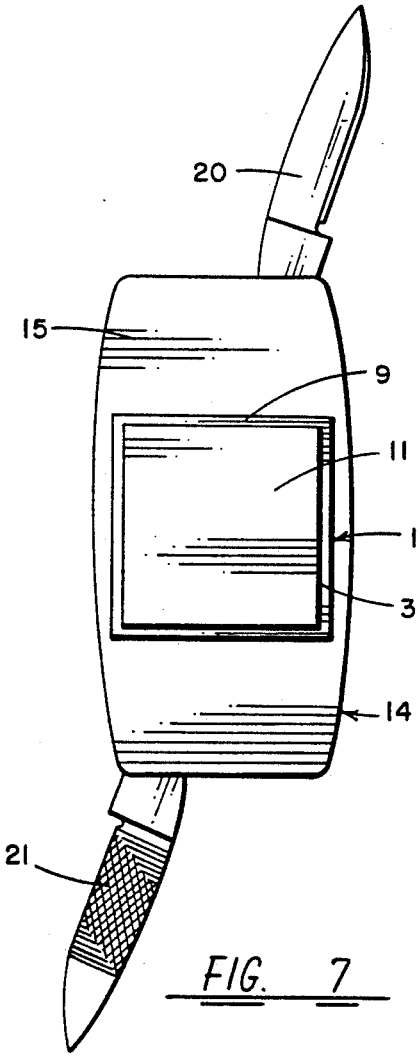
FIG. 7 is a top view of the billiard cue chalk holder of this invention attached to a belt or shirt clip with optional file rasp and trim knife.

In FIG. 6 the billiard chalk holder 1 with chalk block 11 is shown in combination with a belt or shirt clip 14 with a leaf spring 19. The belt clip 14 may have two plates 15 and 16 attached to each other by plate attachment studs 17*a* and 17*b* leaving a space 18 between the plates. As illustrated in FIG. 7, the space between the plates 18 may be used to store a trim knife 20 and a file rasp 21. The knife 20 could be used by players to trim the tip of the billiard cue when it becomes worn. The file rasp 21 could be used to file the tip of the billiard cue to smooth it after cutting.

Figure 8:
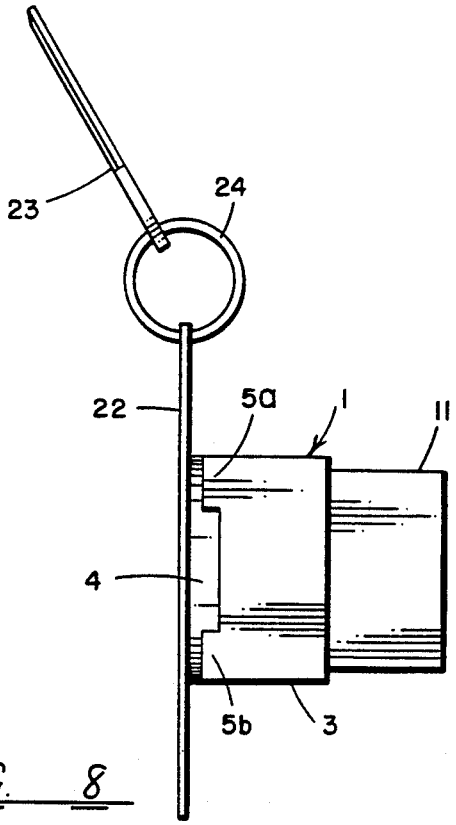
FIG. 8 is a side view of the billiard cue chalk holder of this invention attached to a key chain.

In FIG. 8 the billiard cue holder 1 is shown attached to a metal key chain 22 with keys 23. The key chain 22 could be attached by a key loop 24 to a belt loop to insure that the chalk is readily available for the player.

Although the chalk holder 1 could be made from almost any rigid material, it would preferably be made of plastic so that it has some flexibility for holding a chalk block 11 between the side walls 3 by a pressure fit. The magnet 4 could be a magnetic disk or have another configuration that would fit the bottom of the chalk holder.

A preferred embodiment of a billiard chalk holder of this invention having been described in detail as well as its use in combination with a belt or shirt clip or other metal objects, it is intended that all modifications or variations within the scope or equivalents of the claims are covered by this invention.

Having thus described my invention, I claim:

1. A billiard cue chalk holder having a shape of chalk block to be held in said holder; said holder having a bottom wall, a side wall having a predetermined height, and an open top into which a chalk block is to be inserted;

a magnet offixed to said bottom wall whereby said holder may be attached to a metal surface;

an attachment clip secured to a first metal plate, and a second metal plate permanently secured to said first metal plate in a substantially parallel and spaced apart relationship to define a cavity therebetween;

at billiard tool stored within said cavity; said second metal plate abutting said magnet and attaching said attachment clip to said bottom wall of said chalk holder, said attachment clip serving to attach said chalk holder to a persons garment.

2. The billiard cue chalk holder of claim 1 wherein the bottom surface of the magnet is covered with a spray adhesive to help prevent scratching of the metal surface to which the holder is attached.

3. The billiard cue chalk holder of claim 2 wherein said billiard tool is a trim knife which is pivotally extendable and retractable from between the plates for use in trimming a tip of a billiard cue.

4. The billiard cue chalk holder of claim 2 wherein said billiard tool is a file rasp which is pivotally extendable and retractable from between the plates for use in filing a tip of a billiard cue.

5. The billiard cue chalk holder of claim 2 further comprising a clip secured to a first metal plate permanently affixed to a second metal plate, said plates having a space between them for storing a trim knife and a file rasp which are pivotally extendable and retractable from between the plates for use in trimming and filing a tip of a billiard cue.

6. The billiard cue chalk holder of claim 1 wherein said billiard tool is a trim knife which is rotatably extendable and retractable from between the plates for use in trimming a tip of a billiard cue.

7. The billiard cue chalk holder of claim 1 wherein said billiard tool is a file rasp which is pivotally extendable and retractable from between the plates for use in filing a tip of a billiard cue.

8. The billiard cue chalk holder of claim 1 wherein said billiard tool is a trim knife and a file rasp which are pivotally extendable and retractable from between the plates for use in trimming and filing a tip of a billiard cue.

* * * * *